United States Patent [19]

Schiller

[11] Patent Number: 4,924,576

[45] Date of Patent: May 15, 1990

[54] TOOL HOLDER ASSEMBLY

[76] Inventor: Barry Schiller, 720 N. Flagler, Ft. Lauderdale, Fla. 33304

[21] Appl. No.: 319,272

[22] Filed: Mar. 6, 1989

[51] Int. Cl.[5] ..... B26F 1/00

[52] U.S. Cl. ..... 30/358; 30/167; 30/367; 81/25

[58] Field of Search ..... 30/167, 167.1, 167.2, 30/168, 358, 359, 366–368, 277; 29/254, 275; 83/684, 686, 687, 681, 690; 81/25

[56] References Cited

U.S. PATENT DOCUMENTS 232,645 9/1880 Keyworth ..... 30/167

2,423,189 7/1947 Honhart ..... 81/25

*Primary Examiner*—Douglas D. Watts

*Attorney, Agent, or Firm*—Malloy & Malloy

[57] ABSTRACT

A tool holder assembly of the type used to operatively position leather working tools or the like designed to punch or stamp the material being worked. A mallet, maul or other heavy, hammer-type instrument strikes the tool and forces a work engaging end thereof into penetrating or stamping engagement with the leather or other material being processed. The subject tool holder assembly includes an elongated handle which is intended to be gripped by the hand of the user a spaced distance from a tool receiving portion of the assembly so as to eliminate the danger of the positioning hand of the user being struck by the mallet or like instrument as well as allowing for ease of positioning of the tool.

12 Claims, 3 Drawing Sheets

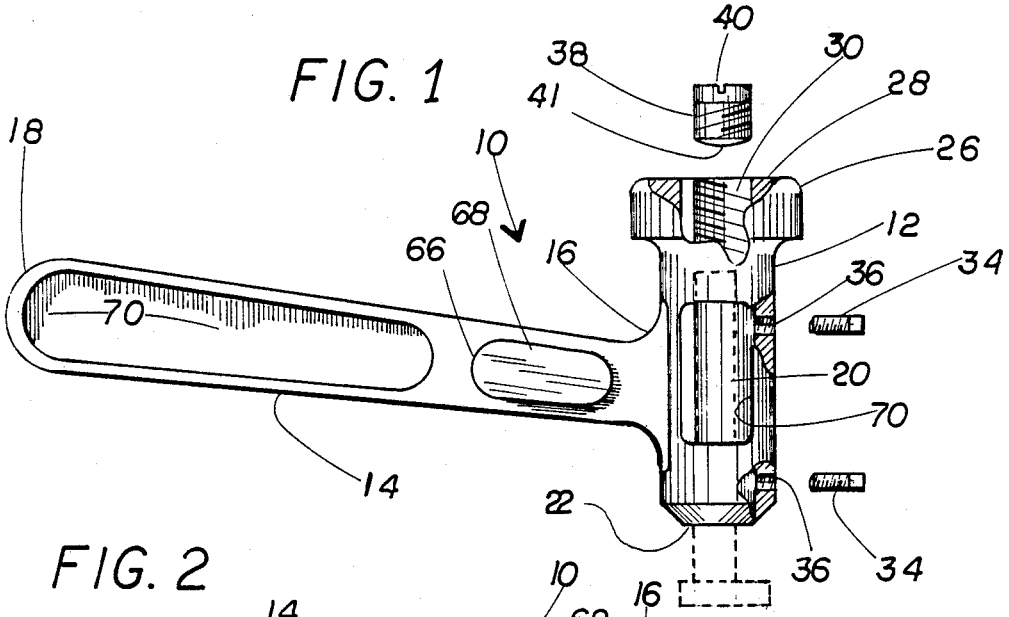
FIG. 1
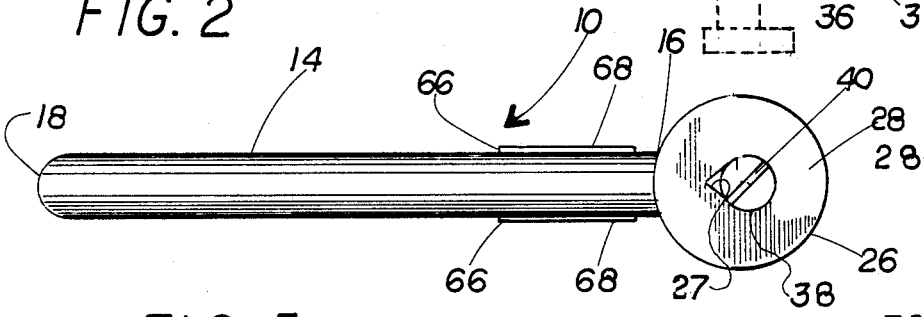
FIG. 2
FIG. 5
FIG. 7
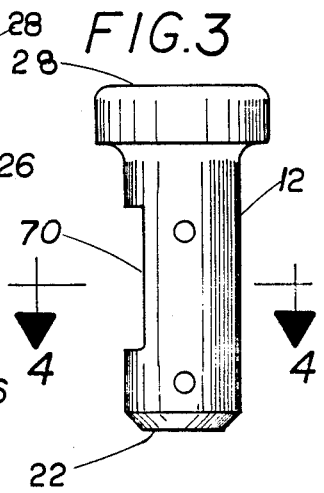
FIG. 3
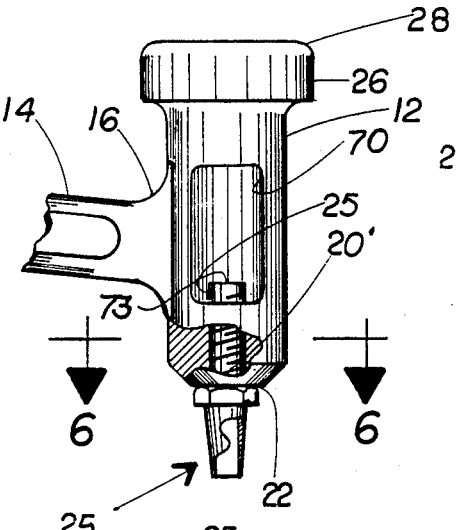
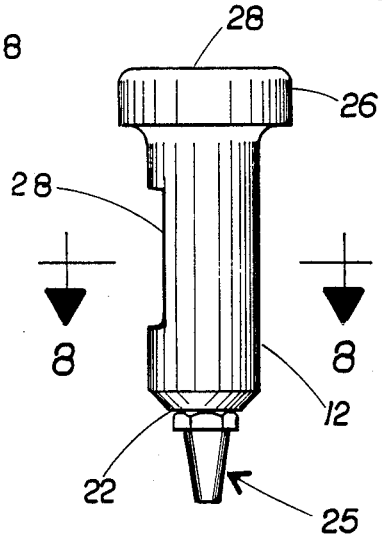
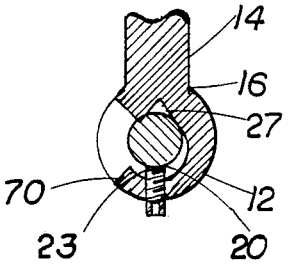
FIG. 4
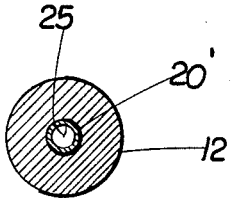
FIG. 6
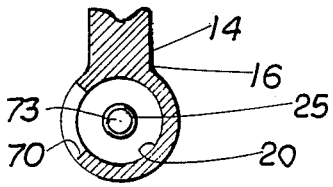
FIG. 8

TOOL HOLDER ASSEMBLY

BACKGROUND OF THE INVENTION

1. Filed of the Invention

This invention relates to a holder assembly used to operatively position a leather working, punching or stamping tool relative to the leather or other material being worked in a manner which eliminates the danger of the positioning hand of the user being struck by a force applying mallet and increases accuracy and ease in the operative positioning of the tool relative to the material.

2. Description of the Prior Art

The general procedure for the use of what may be termed traditional "harness" tools involve the placing of the specific cutting or stamping tool in an operative position defined by a cutting or work engaging end into direct engagement with the materials being processed and subsequently applying a striking force to the upper or exposed end of the tool through the use of a hammer, maul or mallet. The force transferred to the tool causes the work engaging portion to cut, penetrate, stamp and/or puncture the work and/or apply decorative or functional studs, jewels, jewelry, etc. Such harness tools are typically used with leather working but are also adaptable for use with plastic or other, related woven or non-woven materials.

One problem in this industry is the inadvertent striking of the holder's hand which is used to operatively position the work engaging end or portion of the tool in the desired location in contact with the work. Since the striking tool, such as the maul or the like is frequently very heavy, severe and permanent damage to the user's hand is frequently the result. Prior art tools of the type set forth above and/or holder structures therefor are disclosed in the following U.S. Pat. Nos.: 213,984; 1,138,860; 2,307,281; and 4,355,466.

Based on the above, it should be clear that there is an obvious need in this industry for a tool holder assembly which clearly benefits the user of harness tools by minimizing the fear of hand injury thus allowing the force of the striking instrument to be delivered to the tool. Further, a preferred holder assembly would result in an increase in operational quality by allowing greatly improved visibility of the work engaging end or portion of the tool relative to its point of contact with the material being processed.

The construction of such a preferred tool holder assembly in various shapes, sizes and configurations would allow additional versatility for the use of multi-tool combinations.

SUMMARY OF THE INVENTION

The present invention relates to a holder assembly for use in holding, supporting and properly positioning cutting, punching or stamping tools traditionally known as "harness" tools. More specifically, the holder assembly allows support and positioning of the subject tool in its intended, operative position without the hand of the user coming into contact with the tool or in close proximity of the tool. This eliminates the danger of inadvertent striking of the holding hand of the user with a hammer, maul, mallet or like striking instrument commonly used in the leather industry or in procedures involved in the punching, cutting, stamping or installation of various decorative or functional fastening devices onto a given piece of material.

More specifically, a holder portion of the present assembly comprises a head structured to removably and adjustably position the punch or cutting tool therein such that the work engaging portion projects outwardly from the head allowing for the accurate placement thereof in the intended position in contact with the material being processed. The head includes a receiving channel formed on the interior thereof which is generally corresponding to the dimension and/or configuration of the tool being supported and positioned. Further, a securing means is attached to the head in direct association with the receiving channel such that the tool may be properly secured in its intended, supported position relative to the head.

One important feature of the subject assembly is the existence of an elongated handle means having one end fixedly or integrally secured to the head and extending transversely outward therefrom and terminating in a free end. The handle means is specifically designed to be gripped by one hand of the user and is of sufficient longitudinal dimension to insure that the gripping hand is positioned a spaced distance from the head and tool secured therein. The placement of the supporting hand on the handle means in the aforementioned manner and location thereby minimizes the fear of the hand of the user being inadvertently struck when a striking blow or force is delivered to the tool by a conventional striking instrument.

In accord with the structure and intent of the present invention, the tool being held protrudes outwardly from an open, lower end of the channel at one end of the head so as to allow the work engaging portion of the tool to come into contact with the leather or other material being processed. The opposite end of the head has an exposed striking surface or face formed thereon and disposed such that force delivered by the striking instrument to the head will be transferred directly to the tool in a manner which will effectively and evenly distribute the striking force. This provides an accurate punching, cutting or stamping of the work engaging portion of the tool into the material being processed.

Naturally, the configuration, dimension and overall structural features of the head may vary so that the holder assembly may be readily adapted to a plurality of tools of varying sizes and configurations. One such variation would be a structural adaptation of the head to include the support of what may be considered a combination tool. Such a combination tool includes a plurality of cutting or stamping tools disposed in spaced relation to one another. Each of these tools simultaneously engages a piece of work, such as a belt, to shape and cut the end of the belt, form an elongated slot and snap holes to which a buckle is placed.

Other structural features of the present invention include structure of the head portion of the subject holder assembly which allows for the removal of waste portions of the leather material commonly associated with a punch or cutting tool. Typically, the portion removed, by punching or cutting from the leather or like material, passes through the interior of the hollow punch and out the uppermost end thereof. Accordingly, the head portion of the subject holder assembly includes a clearance hole or opening as well as a deflector structure which serves to guide and allow passage of the waste material from the interior of the head once exiting the upper open end of the punch tool.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which:

FIG. 1 is a side view in partial cutaway and section of one embodiment of the present invention.

FIG. 2 is a top view of the embodiment of FIG. 1.

FIG. 3 is a front end view of the embodiment of FIG. 1.

FIG. 4 is a sectional view along line 4—4 of FIG. 2.

FIG. 5 is a side view in partial cutaway and section of another embodiment of the present invention.

FIG. 6 is a sectional view along lines 6—6 of FIG. 5.

FIG. 7 is a front end view of the embodiment of FIG. 5.

FIG. 8 is a sectional view along line 8—8 of FIG. 7.

Like reference numerals refer to like parts throughout the several views of the drawings.

DETAILED DESCRIPTION OF THE PREFERRED EMBODIMENT

Figure 9:
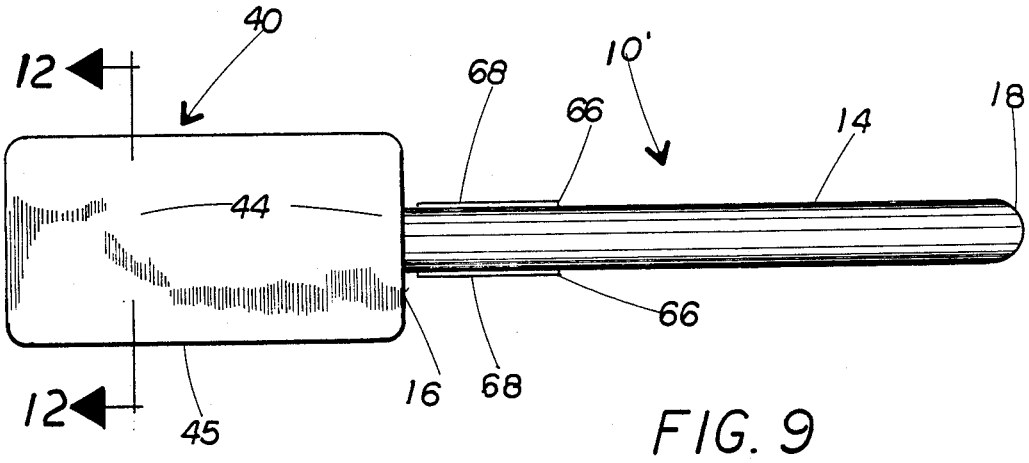
FIG. 9 is a top view of yet another embodiment of the present invention.

As shown in FIGS. 1 through 4, one preferred embodiment of the subject tool holder assembly is generally indicated as 10 and comprises a head 12 and an elongated outwardly extending handle 14 having one fixed end as at 16 attached to the head 12. The opposite end of the handle 14 is free as at 18 and the handle has a sufficient longitudinal dimension so as to be gripped by one hand of the user a spaced distance from the head.

The head comprises a tool receiving portion in the form of an elongated tool receiving channel 20 extending along at least a majority of the length of the elongated head 12. The channel 20 has a lower end as at 22 open such that a tool 21 or like structure may have a work-engaging portion or outer end as at 23 projecting outwardly from the open end 22 as best shown in FIG. 3. By virtue of this disposition of the work-engaging end 23, such end can be properly positioned into contact with the leather or other material being processed. This is all accomplished by manipulation of the holder assembly 10 while the user has his controlling and gripping hand located in gripping engagement with the handle 14 and preferably closer to the free end 18 than the fixed end 16 thereof.

The opposite end of the head 12 comprises an enlarged end 26 having an exposed striking surface as at 28. The striking surface preferably has a somewhat greater transverse dimension than does the remainder of the length of the head 12 including the open end 22. A striking instrument may be struck against the exposed striking surface 28 thereby delivering and transferring adequate force through the head 12 to the work-engaging portion 23 of the tool 21 so as to properly punch, cut, stamp, etc. the leather or like material being processed.

The embodiment of FIGS. 1 through 4 includes a securement means for the maintaining of the tool on the interior of the tool receiving channel 20 in the proper position. This securement means includes at least one but preferably a plurality of set screws 34 each passing through internally threaded apertures as at 36 transversely into engagement with an outer surface of the tool 21 to maintain the tool in the proper position within the channel 20. In addition, this embodiment further includes a substantially V-shaped groove 27 extending along a length of the channel 20 and disposed substantially opposite to the inward projection of the set screws 34 (see FIG. 4). The V-shaped groove 27 is a structural adaptation which cooperates with the set screws to fixedly position tools disposed within the channel 20 which have a significantly lesser diameter than the transverse diameter or dimension of the channel 20. As shown in FIG. 4, the set screws 34 will force the tool 21 against the side walls defining the V-shaped groove thereby allowing the tool receiving channel 20 of the head 12 to receive tools of a variety of transverse dimensions as long as they are of lesser transverse dimension than that of the channel 20.

Also, with regard to the embodiment of FIGS. 1 through 4, a positioning means may be in the form of an externally threaded plug 38 designed to matingly engage the internally threaded surface 30 adjacent the upper end of channel 20. A transverse groove as at 40 may be provided in an exposed end of plug 38 so as to receive a screwdriver or the like and thereby determine the position or depth at which the plug 38 is disposed along the threaded surface 30. The location of the plug 38 in turn determines the location of the tool 21 maintained within the receiving channel 20 since the innermost or upper end of the tool as at 21' will be disposed into abutting engagement with the innermost end 41 of the plug 38. This plug therefore cooperates with the set screws 34 defining the securement means of this embodiment. The innermost or upper end 21' of the tool 21 abuts against the innermost surface 41 of the plug 38 thereby determining the depth or length in which the tool 23 extends into the channel 20 of the head 12. The positioning of the set screws 34 into abutting engagement with the external surface of the tool forces it into centering relation to the V-shaped groove 27 and determines the lateral positioning of the tool on the interior of the channel 20. Accordingly, as best shown in FIG. 3, the outwardly extending or work engaging portion 23 of the tool extending from the open end 22 can thereby be regulated by adjusting the externally threaded plug 38 either inwardly or outwardly along the lengths of the internal thread 30.

Another embodiment of the present invention is shown in FIGS. 5 through 8 and is generally similar to the embodiment of FIG. 1 except that the tool as at 25 has a much shorter length. Further, the securement means in this embodiment is defined by the lower end of the channel 20 as at 20' being internally threaded so as to matingly engage with the external threads on the inner end of the tool 25 as shown best in FIG. 5. The operative or work-engaging end 23' of the tool projects outwardly from the open end 22 of the head 12 or channel 20, 20' similar to the embodiment of FIGS. 1 through 4.

It should be further noted that although the structural differences between the embodiments of FIGS. 1 through 4 and those of FIGS. 5 through 8 are distinguished, such structural differences could in fact be combined. For example, the lower part of the embodiment of FIGS. 1 through 4 could be internally threaded so as to be readily adaptable to externally threaded punch-type tools 25 of the type described with reference to the embodiment of FIGS. 5 through 8. Therefore, in such a "combined" structure, the securement means would include provision for the set screws 34 to accept a tool 21 as well as include the internally threaded lower portion 20' to accept the externally threaded shaft of the tool 25.

Yet another feature common to all the embodiments of the present invention may include a clearance hole 70 or opening formed in the lateral wall of the head 12, to be described in greater detail hereinafter.

Figure 10:
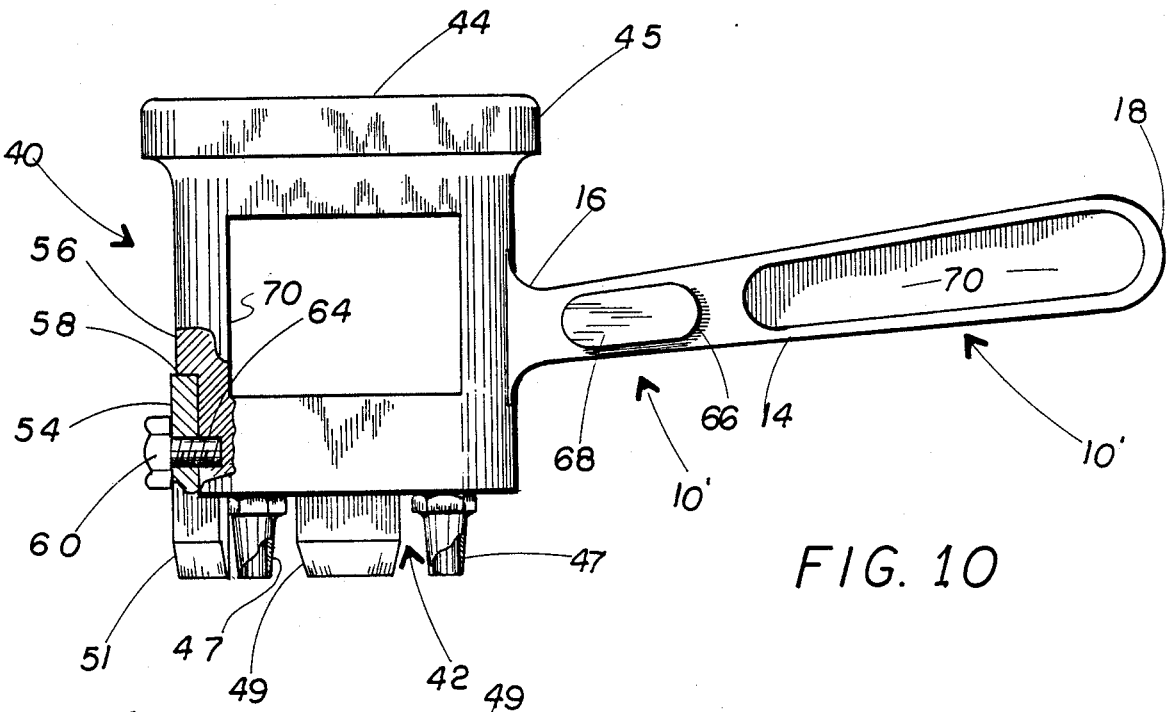
FIG. 10 is a side view in partial cutaway and section of the embodiment of FIG. 9.
Figure 11:
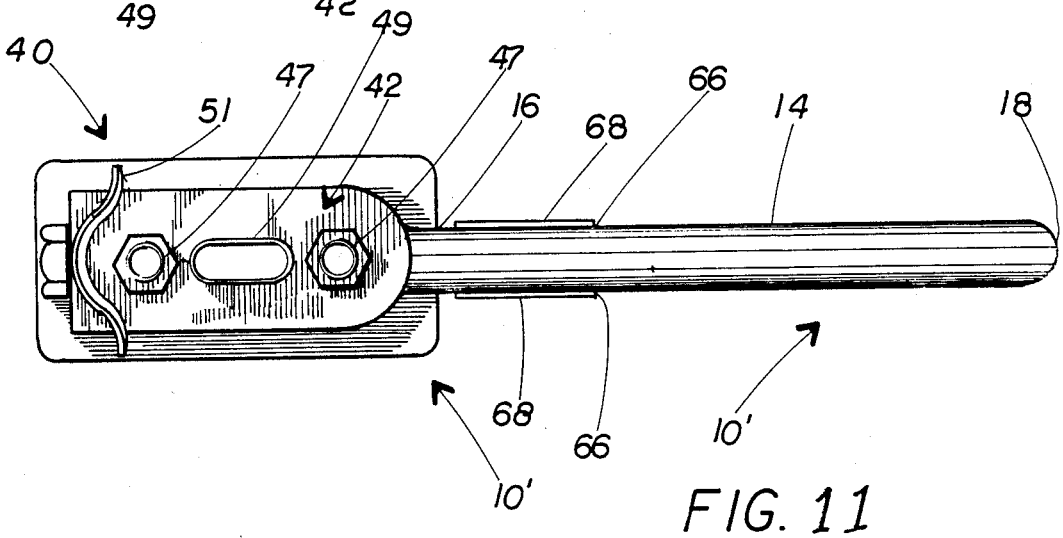
FIG. 11 is a bottom view of the embodiment of FIG. 10.
Figure 12:
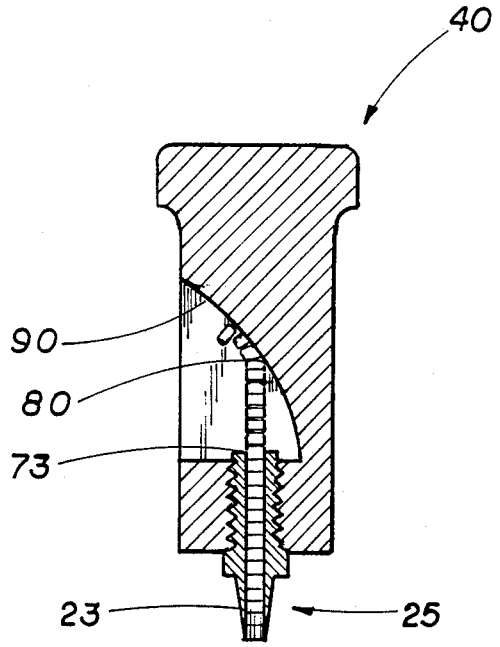
FIG. 12 is a sectional view along line 12—12 of FIG. 9.

Yet another embodiment of the present invention is represented in FIGS. 9 through 11 wherein a holder assembly 10' includes a similar elongated handle 14 having a free end 18 and a fixed end 16 integrally or otherwise securely affixed to a head portion generally indicated as 40. The head differs somewhat from the size and configuration of the head portions of the embodiments of FIGS. 1 through 8 in that it is elongated in order to accommodate a combination tool generally indicated as 42. Other operative and structural features of the head 40 are, however, generally similar to the embodiments of FIGS. 1 through 8 in that the head 40 includes an outer exposed striking surface 44 also being elongated and extending along the length of the head. The interior of the head 40 is at least partially hollow and also includes the clearance opening or aperture 70. In the embodiment shown in FIGS. 9 through 11, the head 40 is specifically structured to receive, on its lowermost end and spaced from the striking surface 44, the combination tool 42. While the actual structure and number of cutting or punching members of the combination tool 42 may vary, the particular combination tool as represented in FIGS. 10 and 11 includes two spaced apart aperture cutters 47 having an elongated slot cutter 49 disposed therebetween and an end cutter as at 51 disposed at one end of the combination tool 42. The combination tool 42 is specifically structured to shape and form the end of a belt (not shown)) to have a curved outer end, two snap holes and an elongated slot for the attachment thereto of a buckle or like connector member. Again it is to be emphasized that other combination tools can be utilized with the holder assembly 10'.

Further, in this embodiment the securement means comprises an outwardly extending flange 51 extending along the length of an outer endmost surface of the head 40 as at 56 and disposed to be received within a recess as at 58 therein. A connector 60 passes through an appropriately positioned aperture in the flange 58 into a receiving internally threaded socket 64 formed in the body of the head 40.

Another feature of the present invention common to all the embodiments of FIGS. 1 through and particularly emphasized in FIGS. is the existence of a clearance aperture or hole 70 formed in the lateral side of the head in open communication with the interior of the head. This clearance hole establishes open communication between the interior of the head 12, 40, regardless of the embodiment, and the exterior of the head. More specifically, when a hollow punch-tool, or cutting tool is utilized, waste particles or material will pass through the interior of the tool and out through the inwardly disposed open end thereof into the interior of the head. Unless otherwise removed, such waste material will continue to accumulate within the head. Particularly when dealing with leather, such particles will form a linear array which may be difficult or inconvenient to remove when such waste material accumulates on the interior of the head in any significant quantity.

Accordingly, the opening 70 allows the particles to pass from the head as they accumulate. In order to facilitate such removal, a deflection means is formed on the interior of the head in various structural embodiments.

Figure 13:
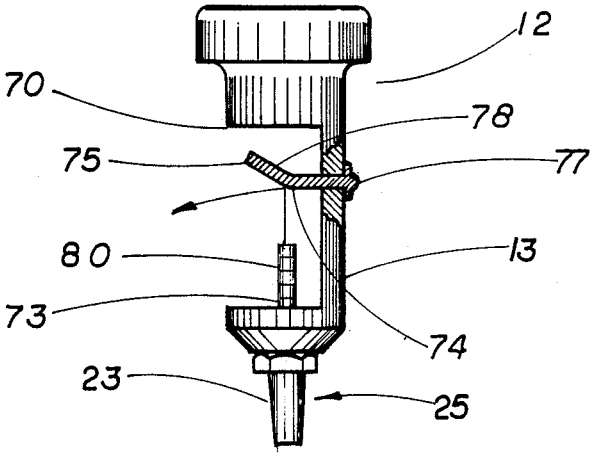
FIG. 13 is a sectional view of another embodiment of the present invention.

With regard to the embodiments of FIGS. 9 through 12, a deflection means in the form of an arcuate or somewhat curved deflection surface 90 may be formed on the interior in generally opposed relation to the clearance opening 70. This deflecting surface serves to engage and channel or direct the accumulated waste particles 80 as they exit from the open end 73 of the punch tool through the clearance opening 70 to the exterior of the head. In another embodiment shown in FIG. 13, the deflection means 74 may be in the form of at least one deflecting pin 75 affixed to a wall portion of the head as at 13 and having an inward portion as at 78 angularly oriented as shown. When in such position, the waste particles 80 engage the pin 75 and are deflected, guided or directed outwardly through the opening 70 and are thereby dispersed from the head as shown. The deflection means 74 may take any of a variety of structural configurations and may be structured somewhat simply similar to a finishing nail or the like wherein the head portion as at 77 is affixed to the wall 13 of the head 12 and the elongated portion 78, is angled outwardly towards the clearance opening or aperture 70 as shown.

Common to each of the embodiments of the present invention, an exposed plate or face as at 66 may be formed along the length of the handle. The exposed surface as at 68 of the plate or like member 66 is specifically dimensioned and disposed to receive identifying indicia thereon so that a user of the holder and positioning assembly 10 or 10' will note the proper "size" and the size of the accompanying tool for which a given holder assembly 10 or 10' is designed to support. The remainder of the length of the handle 14 may be smooth, flattened or recessed as at 70 in order to facilitate gripping thereof as desired.

Now that the invention has been described,

What is claimed is:

1. A tool holder assembly designed to be handheld and removably support, in a work engaging position, a leather working tool for use in punching or stamping leather material, said assembly comprising:

(a) a head having an elongated configuration and structured to removably support the tool therein, said head including a striking surface formed on an outer exposed end thereof, (b) a handle means for positioning said head and tool attached thereto and having a elongated configuration, said handle means including one end fixedly secured to said head and a free end disposed substantially opposite to said head and said one end attached thereto, said handle means extending in transverse relation to said head thereof, (c) said handle means being of sufficient length to be gripped by a hand of the user in spaced, non-contacting relation to the head, (d) a tool receiving portion formed on said head and defined by a channel configured and dimensioned to receive a base portion of the tool in supported engagement therein, (e) securing means mounted on said head and structured for removable engaging relation with the tool disposed within said receiving portion, (f) said securing means comprising an internally threaded surface along a length of said channel and an externally threaded surface formed along the tool, the threaded surfaces being cooperatively disposed for mating engagement with one another and for the removable securement of the tool within said channel, (g) positioning means for determining an operative position of the tool within said channel and comprising a plug having an externally threaded surface for mating engagement with and selective positioning of said plug along a length of said internally threaded surface of said channel, said plug disposed in engaging relation with an inner end of the tool secured within said channel, (h) a clearance opening formed in one wall of said head and disposed to establish open communication between exterior and interior portions of said head, whereby waste material deposited within said head can pass therethrough said clearance opening, (i) deflector means formed within said head in communicating relation to waste material entering said head, said deflector means disposed and configured for directing the waste material to the exterior of the head through said clearance opening, and (j) said tool receiving portion and said securing means cooperatively structured and configured with said tool to dispose a work engaging portion of the tool in outward protruding relation from said head and into the work engaging position.

2. An assembly as in claim 1 wherein said channel is correspondingly configured to receive a major portion of the tool therein along a portion of the length of said channel, said channel having an opening formed at one end thereof and being dimensioned to allow protrusion of the work engaging portion of the tool therethrough out of said channel.

3. An assembly as in claim 2 wherein said striking surface is formed on an end of said head portion opposite to said open end and transversely oriented relative to the length of said head.

4. An assembly as in claim 21 wherein said securing means comprises at least one connector element mounted on said head and extending transversely into said channel into locking engagement with the tool disposed within said channel.

5. An assembly as in claim 4 wherein said one connector element comprises a set screw threadably connected to said head in penetrating relation transversely into said channel and into removable engagement with an outer surface of the tool disposed within said channel.

6. An assembly as in claim 1 wherein said head and said channel comprise a transversely elongated configuration dimensioned to secure a congruently transversely elongated combination tool within said head, said channel including an elongated opening formed in a lower end of said head and being dimensioned and configured to project a work engaging portion of the tool therethrough.

7. An assembly as in claim 6 wherein said striking surface extends along the transverse length of said head and is formed on an outer end of said head substantially opposite to said elongated opening, said striking surface being of sufficient length to apply a striking force at different points along the length of said head.

8. An assembly as in claim 6 wherein said securing means comprises a flange formed on the combination tool and extending outwardly therefrom into overlapping engaging relation to an outer surface of said head, a connector mounted on said flange and positionable into locking engagement with said outer surface of said head.

9. An assembly as in claim 1 wherein said deflector means comprises an interior surface portion formed within said head and including one portion disposed adjacent the tool and another portion extending outwardly therefrom towards said clearance opening and in guiding relation to waste material issuing from the tool into the interior of the head.

10. An assembly as in claim 1 wherein said deflector means comprises an elongated deflector member having one end secured to said head and disposed on the interior thereof and the opposite end extending angularly outward from said one end towards said clearance opening and in interruptive, guiding relation to waste material issuing from the tool into the interior of the head.

11. An assembly as in claim 1 wherein said channel comprises an elongated configuration extending substantially between opposite ends of said head, said securing means comprising at least one connector element mounted on said head and extending transversely into said channel into locking engagement with the tool disposed within said channel; said securing means further comprising a substantially V-shaped groove extending along a length of said channel in substantially opposed relation to said one connector element and in parallel relation to a central longitudinal axis of said channel.

12. An assembly as in claim 11 further comprising a positioning means for determining an operative position of the tool within said channel and comprising a plug having an externally threaded surface matingly engaging and selectively positionable along the length of an interior of said channel, said plug disposed in engaging relation with an inner end of the tool secured within said channel; the position of said plug being determinative of the position of the tool within said channel.

* * * * *